US005642662A

United States Patent [19]

Schwelling

[11] Patent Number: 5,642,662

[45] Date of Patent: Jul. 1, 1997

[54] GUIDE ELEMENTS FOR THE PRESSURE RAM OF WASTE MATERIAL PRESSES

[76] Inventor: Hermann Schwelling, Hartmannweg 5, 88682 Salem, Germany

[21] Appl. No.: 576,806

[22] Filed: Dec. 21, 1995

[30] Foreign Application Priority Data

Dec. 21, 1994 [DE] Germany ..... 9420409 U

[51] Int. Cl.[6] ..... B30B 15/04; B30B 9/30

[52] U.S. Cl. ..... 100/245; 100/258 R

[58] Field of Search ..... 100/3, 46, 229 A, 100/245, 255, 258 R, 258 A

[56] References Cited

U.S. PATENT DOCUMENTS

| | | | |
|---|---|---|---|
| 88,059 | 3/1869 | Millerd | 100/245 |
| 851,714 | 4/1907 | Truelsen | 100/245 |
| 2,428,672 | 10/1947 | McClellan et al. | 100/245 |
| 3,728,959 | 4/1973 | Fredrickson | 100/245 |

FOREIGN PATENT DOCUMENTS

| | | | |
|---|---|---|---|
| 2815248 | 10/1979 | Germany | 100/245 |
| 2055072 | 2/1981 | United Kingdom | 100/245 |

*Primary Examiner*—Stephen F. Gerrity
*Attorney, Agent, or Firm*—Friedrich Kueffner

[57] ABSTRACT

An arrangement of guide elements of the pressure ram of waste material presses for compacting foils, cardboard and similar used packaging material of upright construction, i.e., with vertically acting pressure ram and guidance for support of the pressure ram at the walls of the press shaft in the four corner areas of the cross section of the shaft. The guide elements contacting the rear wall and the side walls of the press shaft are constructed as slide blocks and the guide elements located in the front portion of the press at the inner sides of the front doors of the pressing shaft and filling shaft areas are constructed as roller bodies.

7 Claims, 2 Drawing Sheets

GUIDE ELEMENTS FOR THE PRESSURE RAM OF WASTE MATERIAL PRESSES

BACKGROUND OF THE INVENTION

1. Field of the Invention

The present invention relates to an arrangement of guide elements of the pressure ram of waste material presses for compacting foils, cardboard and similar used packaging material. In particular, the invention is directed to presses of upright construction, i.e., with vertically acting pressure ram and guidance for support of the pressure ram at the walls of the press shaft in the four corner areas of the cross section of the shaft.

2. Description of the Related Art

Guide elements of the above-described type are generally known. However, these guide elements all have the disadvantage that extreme tilting forces, which occasionally inevitably occur and result from non-uniform or different shaft filling with materials of different hardness, are compensated only insufficiently and, as a result, the pressure ram with its pressure plate collides with, becomes caught or is even tilted primarily at the transversely extending gaps or grooves of the divided front wall which is provided with doors, so that the press or the drive elements of the press may be damaged. In addition, this may cause the door locking elements at the front wall or the doors themselves to be damaged, particularly in so-called multichamber presses.

SUMMARY OF THE INVENTION

Therefore, it is the primary object of the present invention to provide guide elements for the pressure ram of a waste material press in which the above-described disadvantages are eliminated. Specifically, a novel arrangement of such guide elements is to be provided in which, even in the case of extreme tilting loads acting on the pressure ram, the pressure ram is still sufficiently guided and no components of the pressure ram can become caught or tilted at the divided front wall of the press shaft.

In accordance with the present invention, the guide elements contacting the rear wall and the side walls of the press shaft are constructed as slide blocks and the guide elements located in the front portion of the press at the inner sides of the front doors of the pressing shaft and filling shaft areas are constructed as roller bodies.

Accordingly, the present invention is primarily directed to a combination of slide blocks and roller bodies which act as guide elements for the pressure ram in a waste material press of upright construction which has a front wall composed of several pieces.

The novel construction according to the present invention makes it especially possible to use greater finishing tolerances which makes the waste material press less expensive, while simultaneously reducing the locations at which damage or problems may occur; any tilting forces are absorbed and cannot reach the bearings of the drive pistons.

In accordance with a special embodiment of the guide element arrangement according to the present invention, each of the four corner areas of the pressure ram has for each wall of the pressing shaft it faces two guide bodies and the distances between the guide bodies between each other are equal and the guide bodies are either offset relative to each other in the direction of operation or are located in the same planes.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
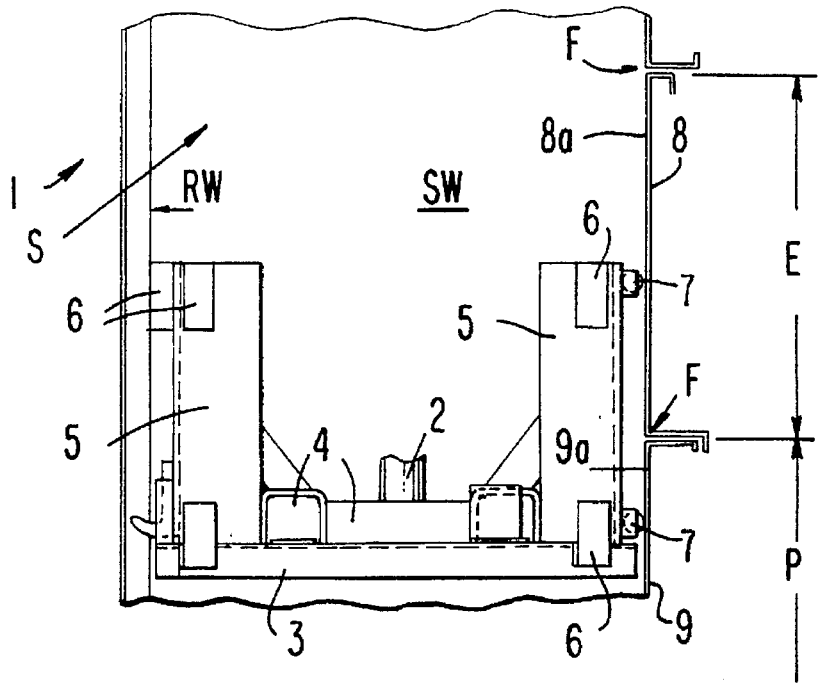
FIG. 1 is a longitudinal sectional view of a waste material press of upright construction.
Figure 2:
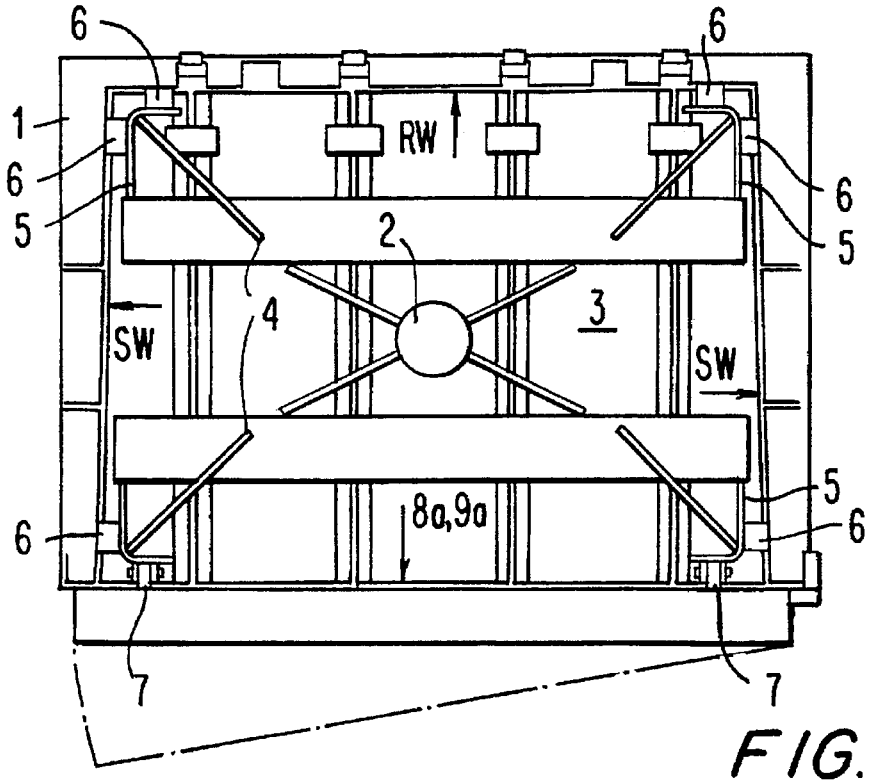
FIG. 2 is a top view of the press of FIG. 1, but rotated by 90°.

The waste material press 1 shown partially and schematically in FIGS. 1 and 2 of the drawing essentially is composed of a vertically acting drive 2 for the pressure ram plate 3 which is reinforced by means of a bending-stiff auxiliary frame 4. Brackets 5 extend upwardly from the four corner areas of the auxiliary frame 4 for mounting the pressure ram guide elements 6 and 7.

In accordance with the present invention, in this waste material press of upright construction, the guide elements located at the rear wall RW and the side walls SW of the press shaft S are constructed as slide blocks 6 and the guide elements located in the front potion of the press at the inner sides 8*a* and 9*a* of the front doors 8 and 9 of the pressing shaft area P and the filling shaft area E are constructed as roller bodies 7. These rollers can now travel without problems over the transverse gaps F at the inner sides 8*a* and 9*a* of the front doors 8 and 9.

Figure 3:
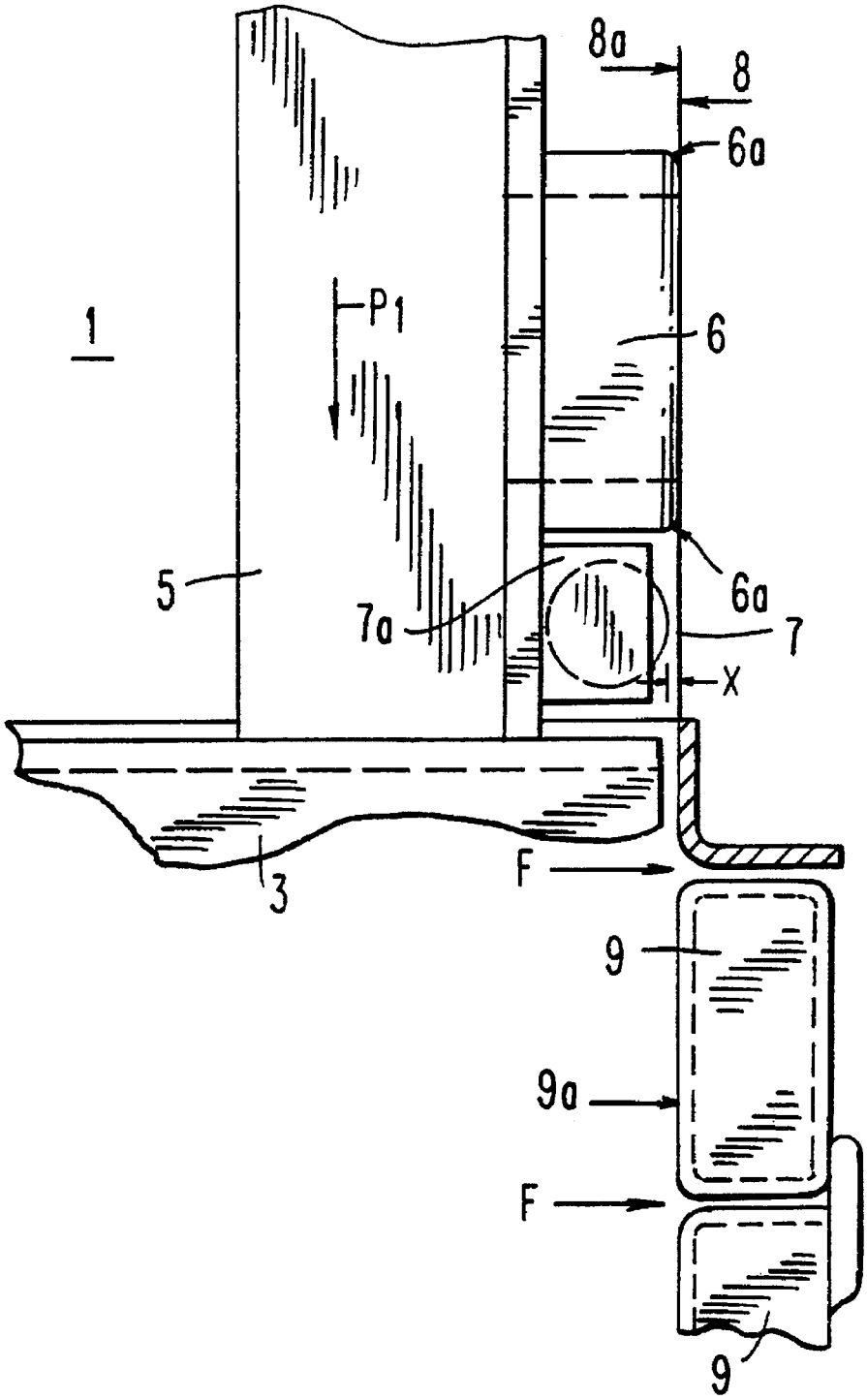
FIG. 3 shows, partially in section and on a larger scale, another embodiment of the area F of FIG. 1.

With respect to the configuration of the slide blocks, it may additionally be advantageous to construct these slide blocks at least in a partial area of their sliding surfaces of synthetic material or to coat these surfaces with synthetic material; it is also conceivable to reinforce the synthetic material with fiber materials Finally, the illustration of FIG. 3 shows the embodiment according to which roller bodies 7 as well as slide blocks 6 can be arranged as guide elements at the inner sides 8*a*, 9*a* of the front door 8, 9. Seen in pressing direction $P_1$ in the illustrated embodiment, the roller bodies 7 with their supports 7*a* are located in front of the slide blocks 6. In addition, the slide blocks 6 have rounded edges 6*a*.

Accordingly, when the pressure ram 3, 4, 5 moves into the door area of the filling shaft E and the pressing shaft P, the rollers 7 initially carry out a centering of the pressure ram particularly in the area of the transverse gaps F, while the slide blocks 6 which slightly protrude relative to the rollers 7 by the dimension x absorb the actual force.

This joint arrangement of rollers 7 and slide blocks 6, 6*a* is advantageous particularly in so-called multichamber presses in which, because of mechanical tolerances and wear, the pressing carriage which can be moved transversely over several chambers cannot always be placed in the exactly correct position relative to the respective pressing chamber.

The invention is not limited by the embodiments described above which are presented as examples only but can be modified in various ways within the scope of protection defined by the appended patent claims.

I claim:

1. A guide arrangement for guiding a pressure ram of a waste material press, the waste material press having a filling chute and a pressing chute with a rear wall, side walls and front doors, the front doors having inner sides, the pressure ram comprising a pressure plate and a bending-stiff auxiliary frame attached to the pressure plate, the auxiliary frame having corners, upwardly extending brackets having upper and lower ends being mounted at the corners of the auxiliary frame, guide elements being mounted on the brackets at the upper and lower ends thereof so as to face one of the rear wall, the side walls and the inner sides of the front doors, wherein the guide elements facing the rear wall and the side walls are slide blocks and the guide elements facing the inner sides of the front doors are roller bodies.

2. The guide arrangement according to claim 1, further comprising additional slide blocks mounted on the brackets adjacent the roller bodies.

3. The guide arrangement according to claim 2, wherein the pressure ram has a pressing direction, and wherein one of the additional slide blocks is arranged behind each of the roller bodies in the pressing direction, and wherein the additional slide blocks protrude slightly beyond the roller bodies toward the inner sides of the front doors.

4. The guide arrangement according to claim 1, wherein, in a pressing direction, the roller bodies and the slide blocks are located on the same planes.

5. The guide arrangement according to claim 1, wherein the slide blocks have slide surfaces, wherein at least portions of the slide surfaces are of synthetic material.

6. The guide arrangement according to claim 5, wherein the synthetic material is reinforced with fiber materials.

7. The guide arrangement according to claim 1, wherein the slide blocks have slide surfaces, wherein at least portions of the slide surfaces are coated with synthetic material.

* * * * *